US007625423B2

(12) United States Patent
Kaschub et al.

(10) Patent No.: US 7,625,423 B2
(45) Date of Patent: Dec. 1, 2009

(54) METHOD FOR OBTAINING PURE COPPER

(75) Inventors: Hartwig Kaschub, Essen (DE); Martin Blanke, Duisburg (DE)

(73) Assignee: Xstrata Technology Pty Ltd., Brisbane, Queensland (AU)

( * ) Notice: Subject to any disclaimer, the term of this patent is extended or adjusted under 35 U.S.C. 154(b) by 502 days.

(21) Appl. No.: 11/245,286

(22) Filed: Oct. 6, 2005

(65) Prior Publication Data

US 2006/0086206 A1 Apr. 27, 2006

(30) Foreign Application Priority Data

Oct. 9, 2004 (DE) ..... 10 2004 049 234

(51) Int. Cl.
*C22B 15/00* (2006.01)
*C21B 7/22* (2006.01)
*C21C 5/38* (2006.01)
*C21C 5/40* (2006.01)

(52) U.S. Cl. ..... 75/649; 266/155

(58) Field of Classification Search ..... 75/649, 75/392, 414, 585, 638, 646–648, 707, 10.1, 75/10.29, 10.36, 10.64, 10.65, 406, 407, 75/411, 653, 708; 266/44, 46, 47, 144, 200, 266/212, 214, 216–218, 225, 243, 265, 287, 266/903, 155

See application file for complete search history.

(56) References Cited

U.S. PATENT DOCUMENTS 1,400,892 A * 12/1921 Martin ..... 75/638
1,863,419 A * 6/1932 Snelling ..... 75/649
3,463,472 A 8/1969 Worner
3,788,281 A * 1/1974 Van Lookeren Campagne 122/7 R
4,903,640 A * 2/1990 Howard ..... 122/6 A
5,299,785 A 4/1994 Cappelli et al.
5,940,270 A * 8/1999 Puckett ..... 361/699
6,418,157 B1 7/2002 Fox

FOREIGN PATENT DOCUMENTS

DE 13484 11/1956
DE 41 26 237 A1 3/1993
DE 10047555 3/2001
EP 0 784 193 7/1997

* cited by examiner

*Primary Examiner*—George Wyszomierski
*Assistant Examiner*—Vanessa Velasquez
(74) *Attorney, Agent, or Firm*—Collard & Roe, P.C.

(57) ABSTRACT

A method for obtaining pure copper is provided wherein oxygen is blown onto a copper melt, in a melting furnace lined with refractory material, having a waste heat boiler set onto it, in order to oxidize contaminants contained in the melt and thereby remove them from the melt, and wherein a splash protection device through which water flows is provided above the copper melt, on the inside wall of the melting furnace, which prevents copper that splashes out of the copper melt from penetrating into the waste heat boiler. Boiling water is used for cooling the splash protection device, which water is under a pressure of more than 5 bar and is evaporated, at least in part, as it flows through the splash protection device.

6 Claims, 2 Drawing Sheets

8
3
4
2
A
A
6
12
7
5

METHOD FOR OBTAINING PURE COPPER

CROSS REFERENCE TO RELATED APPLICATIONS

Applicants claim priority under 35 U.S.C. §119 of German Application No. 10 2004 049 234.4 filed Oct. 9, 2004.

BACKGROUND OF THE INVENTION

1. Field of the Invention

The present invention relates to a method for obtaining pure copper. More specifically, in the method, oxygen is blown onto a copper melt, in a melting furnace lined with refractory material, having a waste heat boiler set onto it, in order to oxidize contaminants contained in the melt and thereby remove them from the melt. In addition, a splash protection device through which water flows is provided above the copper melt, on the inside wall of the melting furnace. The splash protection device prevents copper that splashes out of the copper melt from penetrating into the waste heat boiler.

2. The Prior Art

Methods having the characteristics described above are known in practice. The splash protection device, which is frequently also referred to as a so-called splash block, generally is made of copper. The splash protection device is necessary because moisture that is introduced into the melt together with the oxygen, for example, through a lance, evaporates explosively and entrains liquid copper a long way upward with it, as it explodes. The splash block, which is attached to the inside wall of the melting furnace, below the waste heat boiler, prevents the entry of drops of melt into the waste heat boiler, and protects the boiler from an inside coating of solidified copper.

Within the scope of the known measures, the splash block has pipes that are made of copper, for guiding a non-preheated cooling water, which pipes are cast into a copper block. However, although melting of the copper is effectively prevented by means of the cold cooling water, erosion corrosion takes place at the copper block, because of sulfur contained in the copper melt. As a result, it becomes necessary to replace the splash block after only a few months. Another problem is that if a crack caused by corrosion phenomena occurs in the splash block, cold cooling water penetrates into the copper melt. The water evaporates explosively there and thereby results in a massive impact of solidifying copper splashed out of the melt against the waste heat boiler.

DE 100 47 555 A1 describes a cover for a metallurgical melting furnace, which cover has cooling channels through which cold water flows. Furthermore, it is known from the German Offenlegungsschrift D 13484 VI/18b to use boiling water for cooling chimney walls, and to use the evaporation enthalpy for cooling. The water is passed along the chimney wall in long, vertical riser lines. Because of the great height of the chimney, a vigorous water circulation occurs in the riser lines, in this connection, allowing effective cooling of the chimney wall. The measures described in the Offenlegungsschrift do not make any contribution toward solving the set of problems described above.

SUMMARY OF THE INVENTION

It is an object of the present invention to provide a method having the characteristics described above, which guarantees an increased useful lifetime of the splash protection device.

These and other objects are accomplished, according to the invention, by using boiling water for cooling the splash protection device. The water is under a pressure of more than 5 bar and reaches boiling temperature as it flows through the splash protection device.

The invention is based on the recognition that the erosion corrosion speed decreases with an increasing temperature of the splash protection device and, in particular, that erosion corrosion that is relevant for practice can no longer be found at temperatures above 200° C.

According to a preferred embodiment of the invention, the boiling water pressure is more than 20 bar, corresponding to a boiling temperature of about 212° C. Under some circumstances, however, boiling water pressures of more than 5 bar or more than 10 bar, respectively, are already sufficient to guarantee a sufficiently long useful lifetime. It is practical if the water is already close to the boiling point as it enters into the splash protection device. Having the water close to boiling has the additional advantage that a crack occurs in the splash protection device, or if another kind of leak occurs, no cold water gets into the copper melt, because the boiling water evaporates immediately upon entering the melting furnace atmosphere.

In another embodiment, the boiling water is connected to a cooling water circuit of the waste heat boiler in the inflow and outflow. In this way, circulation pumps of a boiler system that includes the waste heat boiler, which are present, can be advantageously used to transport the water that flows through the waste heat boiler. Furthermore, the steam that is generated as the water flows through the splash protection device can be passed to a heat recovery device of the boiler system.

It is practical if the splash protection device has pipes through which the boiling water flows, and which are cast into a copper block that serves as the splash protection. The pipes can be made of steel, preferably alloy steel, and thereby also withstand higher pressures. The splash protection device may also have steel pipes that are mantled with a monolithic lining material. For example chamotte or a similar material may be used as the lining material.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
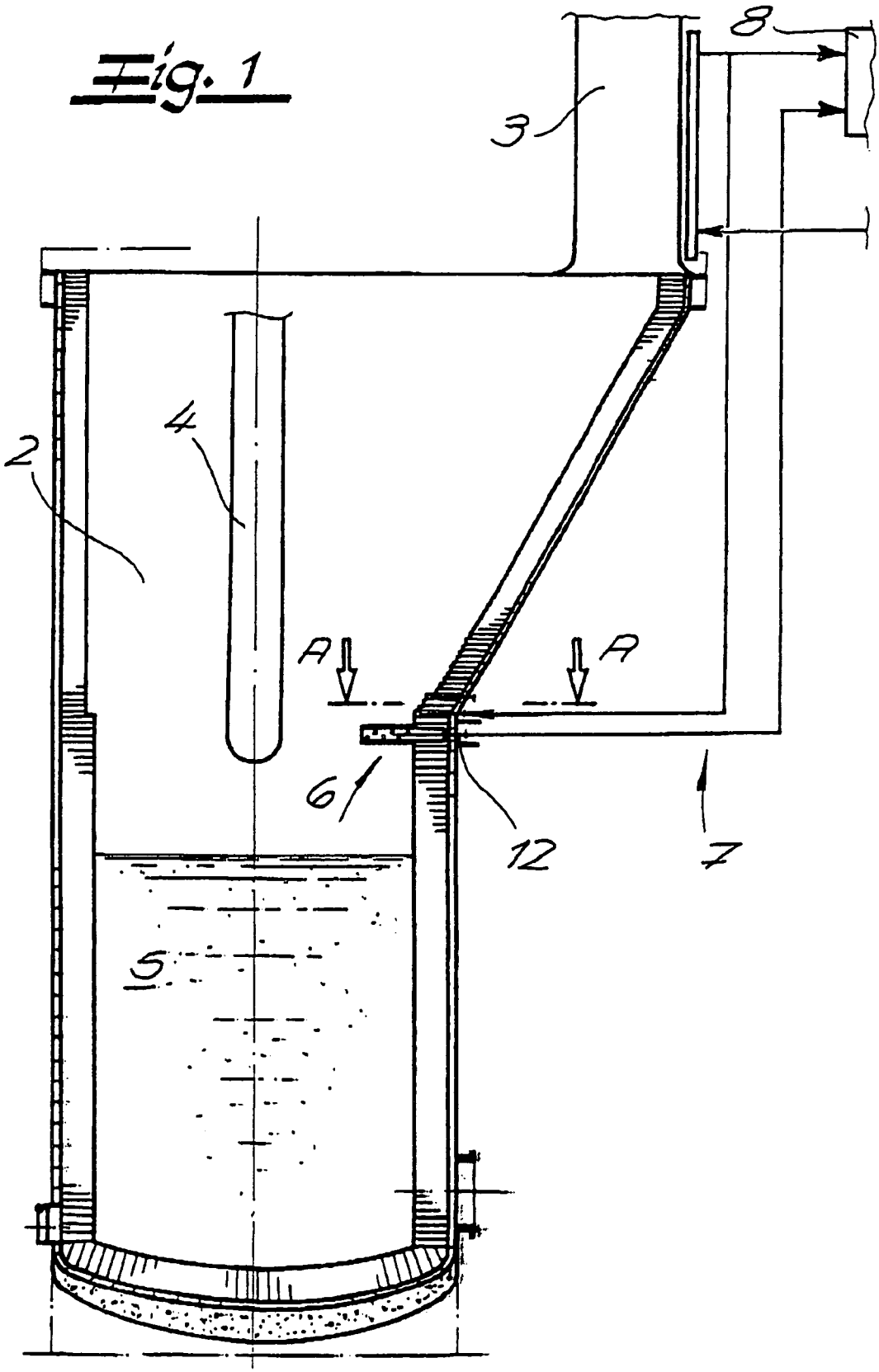
FIG. 1 is a side view of a system for implementing the method according to the invention, in a cross-sectional view.

FIG. 1 shows a detail of a system for obtaining pure copper. The system has a melting furnace 2 lined with refractory material. Melting furnace 2 has a waste heat boiler 3 set onto it at a lateral offset. Oxygen, or even air, is blown onto a copper melt 5 that is located in the melting furnace, using a lance 4, in order to oxidize contaminants contained in melt 5 and thereby remove them from melt 5. While the solid oxidation products generally accumulate at the surface of the copper melt 5 as slag, the gaseous oxidation products are transported away from the melt furnace 2 by way of waste heat boiler 3. The temperature of copper melt 5 is approximately 1,300° C., whereas the waste gases that are formed in waste heat boiler 3 are cooled off to approximately 700° C.

Waste heat boiler 3 is followed by another cooling device in the form of a quench, not shown, which cools the waste gases down to approximately 350° C. Above copper melt 5, on the inside wall of melting furnace 2, a splash protection device 6 is attached. Splash protection device 6 prevents copper that splashes out of copper melt 5 from penetrating into waste heat boiler 3. Boiling water under pressure, which flows through the splash protection device, is used to cool splash protection device 6. Boiling water means water at a pressure of more than 5 bar, which reaches boiling temperature as it flows through the splash protection device and is partially evaporated. In the exemplary embodiment, the boiling water pressure is 40 bar, which corresponds to a boiling temperature of approximately 250° C. The water enters into splash protection device 6 at a temperature below the boiling point, and reaches boiling temperature as it flows through the splash protection device.

Splash protection device 6 is connected with a cooling water circuit 7 of waste heat boiler 3. The boiling water/steam mixture that leaves splash protection device 6 is returned to a heat recovery device 8 assigned to the waste heat boiler.

Figure 2:
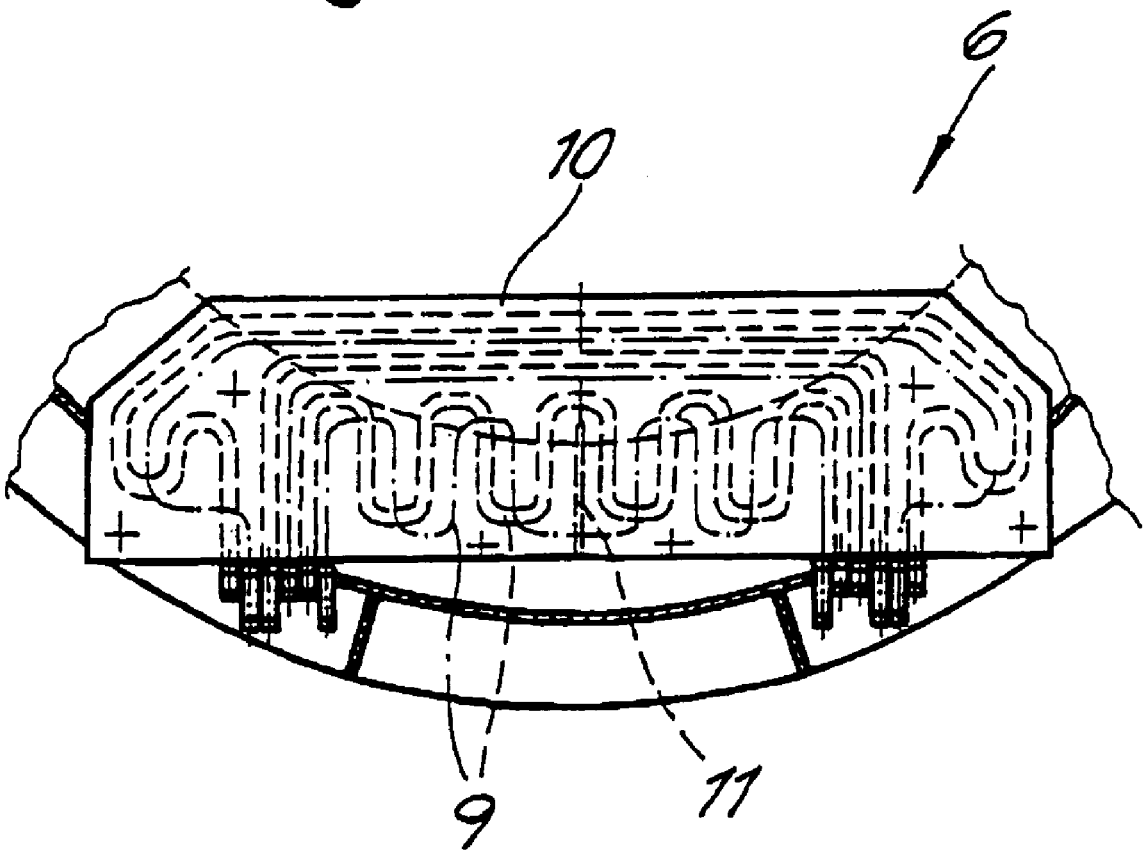
FIG. 2 is the cross-section A-A from FIG. 1.

As shown in FIG. 2, splash protection device 6 has pipes 9 through which the boiling water flows. The pipes are cast into a copper block 10 that serves as splash protection. The pipes are made of an alloy steel. Copper block 10 furthermore has a bore 11 for accommodating a temperature sensor 12 for detecting the temperature of copper block 10.

Although only a few embodiments of the present invention have been shown and described, it is to be understood that many changes and modifications may be made thereunto without departing from the spirit and scope of the invention as defined in the appended claims.

What is claimed is:

1. A method for purifying copper comprising:

(a) blowing oxygen onto a copper melt in a melting furnace lined with refractory material and having a waste heat boiler set onto the melting furnace in order to oxidize contaminants contained in the melt and thereby remove the contaminants from the melt;

(b) providing a splash protection device above the copper melt on an inside wall of the melting furnace, the splash protection device preventing copper splashing out of the copper melt from penetrating into the waste heat boiler; and (c) causing boiling water to flow through the splash protection device to cool the splash protection device, the boiling water being under a pressure of more than five bar and the temperature of the splash protection device is more than 200° C. and the water is evaporated at least in part as the water flows through the splash protection device, the temperature of the splash protection device serving to eliminate erosion corrosion in the splash protection device.

2. The method according to claim 1, wherein the pressure of the boiling water is more than 20 bar.

3. The method according to claim 1, wherein the boiling water is connected with a cooling water circuit of the waste heat boiler, during inflow and outflow.

4. The method according to claim 1, wherein the splash protection device has pipes through which the boiling water flows, the pipes being cast into a copper block that serves as splash protection.

5. The method according to claim 4, wherein the pipes are made of steel.

6. The method according to claim 5, wherein the steel is an alloy steel.

* * * * *

UNITED STATES PATENT AND TRADEMARK OFFICE

CERTIFICATE OF CORRECTION

PATENT NO. : 7,625,423 B2
APPLICATION NO. : 11/245286
DATED : December 1, 2009
INVENTOR(S) : Kaschub et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 646 days.

Signed and Sealed this

Twenty-sixth Day of October, 2010

David J. Kappos

David J. Kappos
*Director of the United States Patent and Trademark Office*